52-79.1 SR
2/24/87 XR 4,644,708

United States Patent [19]
Baudot et al.

[11] Patent Number: 4,644,708
[45] Date of Patent: Feb. 24, 1987

[54] PREFABRICATED MODULAR BUILDING ELEMENT AND A BUILDING COMPRISING SUCH ELEMENTS

[75] Inventors: Claude Baudot, Thionville; Vincent Contini, Konacker, both of France

[73] Assignee: Constructions Metalliques Fillod, Florange, France

[21] Appl. No.: 821,446

[22] Filed: Jan. 22, 1986

[30] Foreign Application Priority Data

Oct. 3, 1985 [FR] France ..... 85 14647

[51] Int. Cl.[4] ..... E04B 1/348
[52] U.S. Cl. ..... 52/79.9; 52/79.1; 52/79.7; 52/123.1; 52/125.6
[58] Field of Search ..... 52/79.1, 79.7, 79.9, 52/123.1, 125.2, 125.6, 185, 637

[56] References Cited

U.S. PATENT DOCUMENTS

| | | | |
|---|---|---|---|
| Re. 30,229 | 3/1980 | Berman et al. | 52/125.6 |
| 3,225,434 | 12/1985 | Van Der Lely et al. | 52/79.1 X |
| 3,422,582 | 1/1969 | Van Der Lely | 52/79.7 |
| 3,461,633 | 8/1969 | Ziegelman et al. | 52/79.9 X |
| 3,605,350 | 9/1971 | Bowers | 52/79.7 X |
| 3,717,964 | 2/1973 | Brown et al. | 52/79.1 |
| 4,106,243 | 8/1978 | Horn | 52/79.1 X |

FOREIGN PATENT DOCUMENTS

| | | | |
|---|---|---|---|
| 3016205 | 11/1980 | Fed. Rep. of Germany | 52/79.1 |
| 1330995 | 5/1963 | France | 52/79.1 |
| 2352135 | 12/1977 | France | 52/79.1 |
| 76085 | 6/1969 | German Democratic Rep. | 52/79.1 |

*Primary Examiner*—Alfred C. Perham
*Attorney, Agent, or Firm*—Oblon, Fisher Spivak, McClelland & Maier

[57] ABSTRACT

A prefabricated modular building element comprising a floor formed by the assembly together of two identical metal half frames each formed by an assembly of longitudinal members and cross pieces, a ceiling comprising longitudinal members and spacers, or longitudinal members and purlins connected by corner posts to said ceiling so as to form a self supporting structure whose constituent parts are assembled together by means of bolts or similar devices, and lifting members removably-attached by bolt-type devices at predetermined zones of said structure.

12 Claims, 16 Drawing Figures

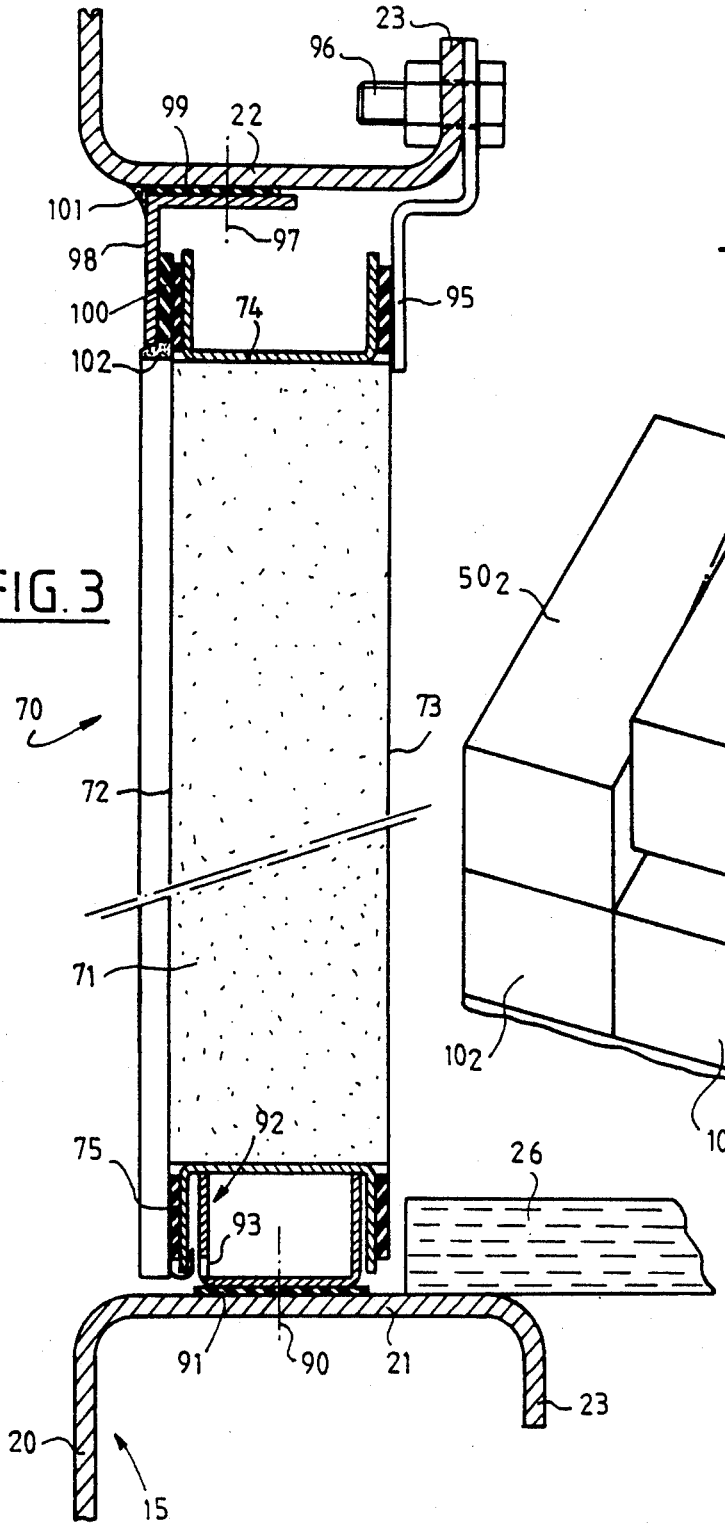
FIG. 3
FIG. 14
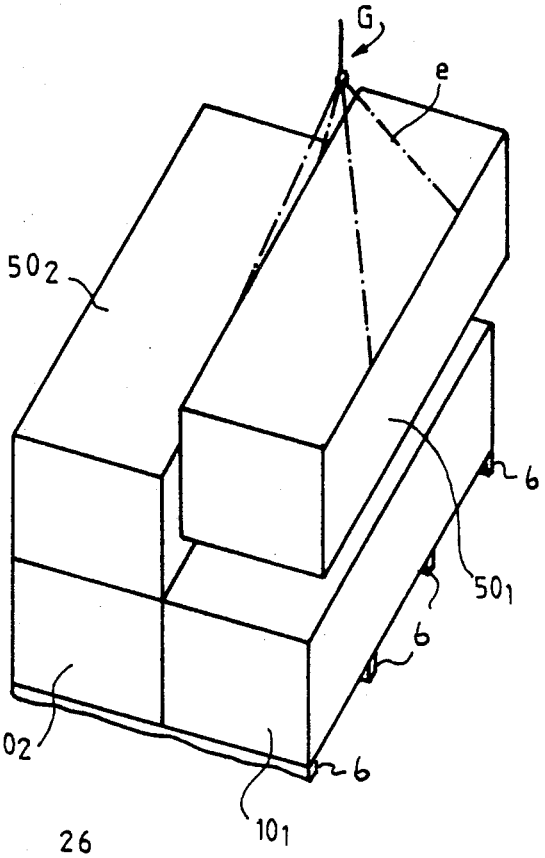

PREFABRICATED MODULAR BUILDING ELEMENT AND A BUILDING COMPRISING SUCH ELEMENTS

BACKGROUND OF THE INVENTION

The invention relates to a prefabricated modular building element and the buildings obtained by assembling such elements.

It provides in particular such a self supporting metal structure element capable of being superimposed and/or joined side by side to adjacent elements for forming a complete building when said elements are assembled together.

The aim of the invention is generally to provide such an element which allows a multiplicity of buildings to be formed from an extremely reduced number of basic modular elements for obtaining buildings answering better the specific requirements related to the environment and/or appearance requirements and/or to architectural requirements.

Thus an aim of the invention is to provide such an element which allows buildings to be formed for dwelling, teaching, commercial and/or office use and whose inner appointments may be chosen at will depending on the desiderata of their users.

It is also an aim of the invention to provide such an element allowing a building to be formed using only simple and rapid means for assembling the elements together, in particular which allows the construction of complete buildings with metal framework without requiring, on the constructional site, cutting and/or welding means.

In this respect it is an aim of the invention to provide a prefabricated modular element which allows buildings to be formed using a little qualified or unqualified workforce only disposing of simple assembly means and handling, particularly lifting, means which are to be found usually on constructional sites.

It is finally an aim of the invention to provide such an element which, prefabricated in the factory, is readily transportable from its place of manufacture to its place of use, in particular in the form of loads of standardized dimensions as is usual in container transport.

SUMMARY OF THE INVENTION

A prefabricated modular building element in accordance with the invention is characterized in that it comprises a floor formed by the assembly together of two identical metal half frames each formed by an assembly of longitudinal members and cross pieces, a ceiling comprising longitudinal members and spacers, or longitudinal members and purlins connected by corner posts to said ceiling so as to form a self supporting structure whose constituent parts are assembled together by means of bolts or similar and means for lifting the element removably attached by bolt type means at predetermined zones of said structure.

In one embodiment of the invention, the element comprising a ceiling with longitudinal members and cross pieces is intended to form the ground floor of a building whereas the element comprising a ceiling with longitudinal members and purlins is intended to form the current story of said building when the latter results from the superimposition and assembly together of two such elements.

The floor and ceiling longitudinal members are formed from steel sections having advantageously a cross section in the form of ⊏, i.e. in the form of a U having parallel flanges with, at the end of one of said flanges, a bend perpendicular to said flanges.

In a preferred embodiment, the floor longitudinal members and the ceiling longitudinal members are connected at their free ends by edge beams and said beams are steel sections having the same cross section as the one defined above for the longitudinal members.

The element intended to form the current story of a building is further characterized in that it comprises roof means, advantageously having the form of trays adapted to be fixed by screws or the like to said purlins and means for completing the roof such as string-courses, gutters and similar.

The frontages of an element in accordance with the invention are formed as non bearing curtain walls and are advantageously formed by assembling together solid panels or panels having a door and/or a window included therein and comprising a web made from a foam material covered with metal plates and whose periphery is a channel section made integral with said metal sheets with interposition of a seal.

For mounting the curtain walls formed of said panels, the longitudinal members and/or the corner posts are provided with means such as channel sections with which may cooperate the peripheral sections of said panels as well as L or Z section means for holding said panels in position.

For connecting two adjacent panels together, T shaped butt strips are provided adapted to be fixed together by engagement of screws with lips forming the end of the web of one of the strips with interposition of sealing means.

For handling an element in accordance with the invention between the place of assembly and the place of use internal tie rod means are temporarily associated with said element and are fixed by nuts and lock nuts between the facing flanges of the floor longitudinal members and of the ceiling longitudinal members as well as external tie bolts fixed by nuts and lock nuts between brackets themselves fixed by bolting to the substantially coplanar webs of the facing floor and ceiling longitudinal members.

A building in accordance with the invention, formed by assembling modular elements such as defined above together is characterized in that it comprises a ground floor formed by at least one element whose ceiling comprises longitudinal members and spacers and at least one current story element whose ceiling comprises longitudinal members and purlins covered with roof trays, said elements being joined together by means of bolts or the like with interpositioning of a seal between the ceiling longitudinal members of the ground floor elements and the floor longitudinal members of the current story elements.

In one embodiment, a building in accordance with the invention comprises a plurality of juxtaposed elements, not only ground floor but also current story elements, joined together by bolts or the like disposed horizontally for connecting together adjacent longitudinal members and vertically for connecting together superimposed longitudinal members.

BRIEF DESCRIPTION OF THE DRAWINGS

The invention will be better understood from the following description given by way of example with reference to the accompanying drawings in which:

FIG. 3 is a partial view in section and on a larger scale illustrating the assembly of a panel intended to form an external surrounding wall of a building in accordance with the invention;

FIG. 14 is a view illustrating very schematically the structure of a building formed from elements according to the invention;

DESCRIPTION OF THE PREFERRED EMBODIMENTS

Figure 1:
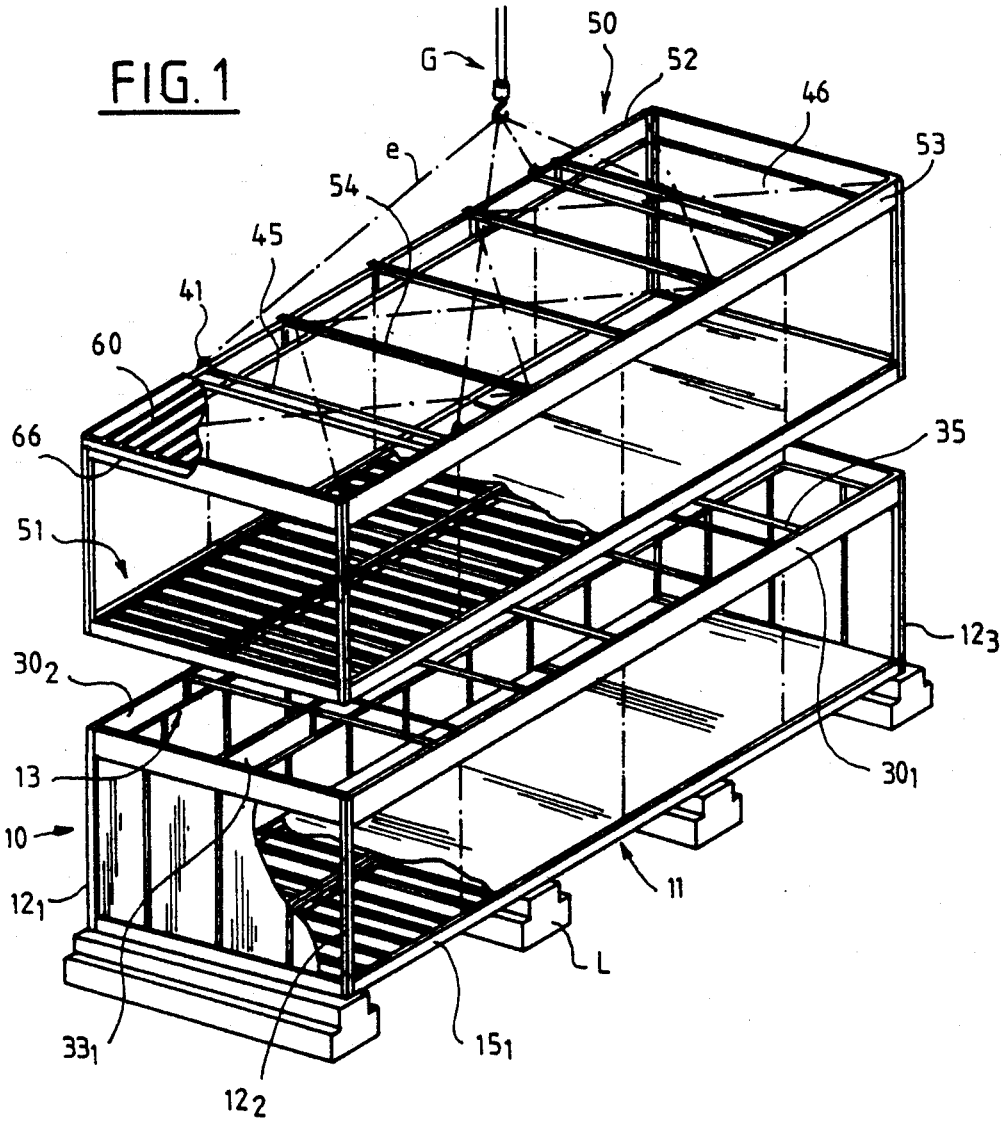
FIG. 1 is a perspective view, with parts cut away of two prefabricated modular elements in accordance with the invention.
Figure 2:
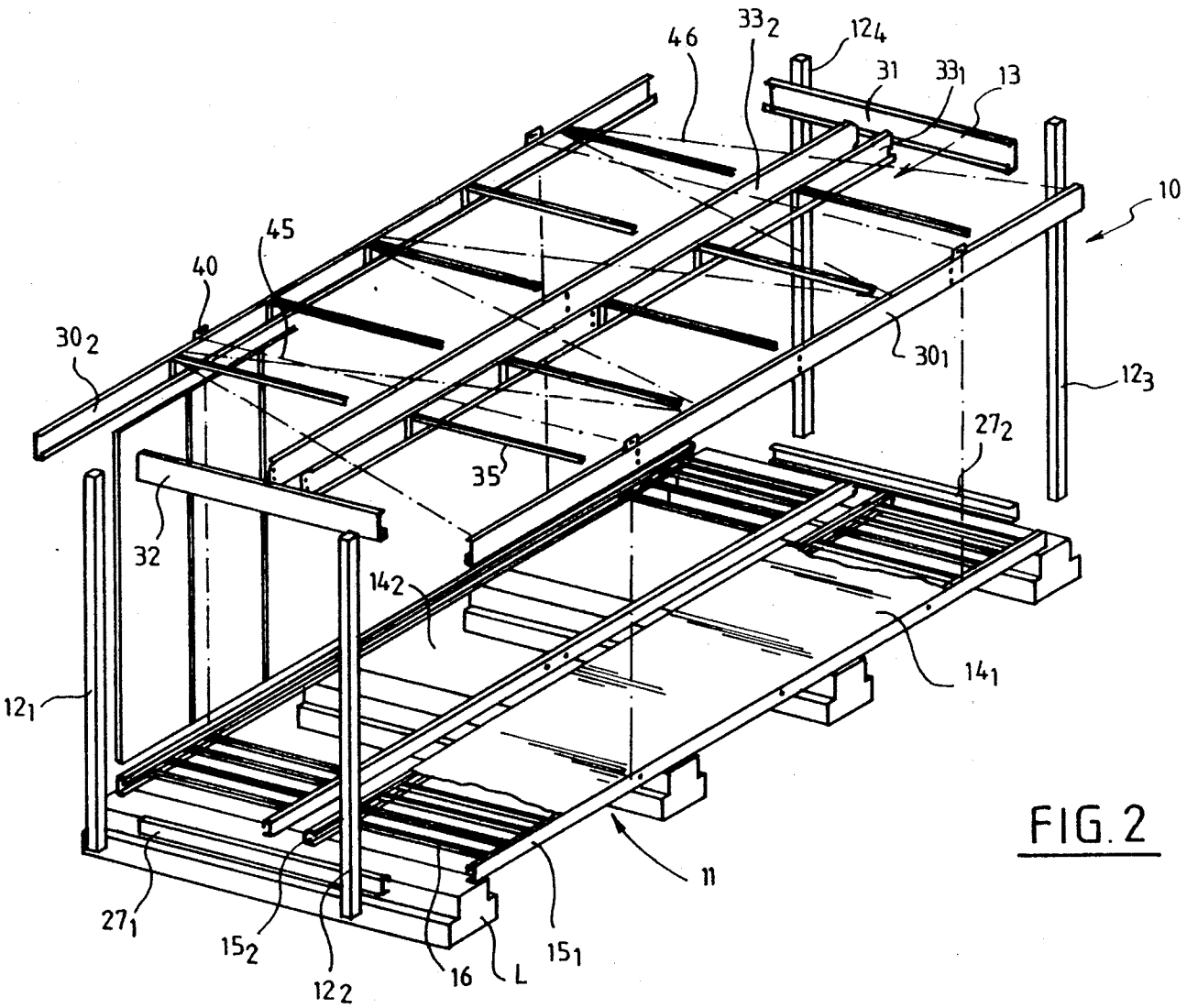
FIG. 2 is an exploded perspective view of an element according to the invention.

Reference is made first of all to FIGS. 1 and 2 which show, in a perspective view, a prefabricated modular building element 10 according to the invention, having a generally parallelepipedic shape, and which comprises a floor 11, corner uprights $12_1$, $12_2$, $12_3$, $12_4$ and a ceiling 13.

According to the invention,the floor 11 is formed by assembling together two identical half frames $14_1$, $14_2$, each of which is formed by two longitudinal members $15_1$, and $15_2$ joined together by cross pieces 16.

Figure 7:
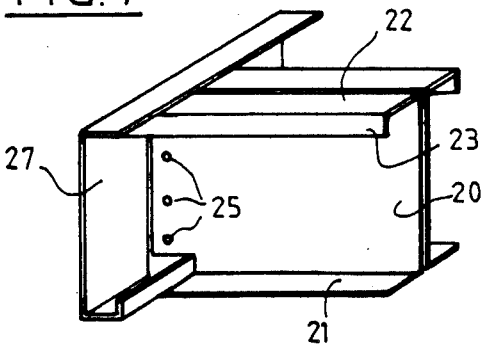
FIGS. 7 to 12 are detail views of elements according to the invention.

The longitudinal members 15 are advantageously steel sections having a cross section in the shape of ⊏ i.e. channel section with a web 20 to which are connected by rounded portions flanges 21 and 22 one only of which is extended, after a rounded portion, by a bend 23 parallel to web 20 but of a length much shorter than that of this latter (FIG. 7). The longitudinal members 15, whose length is of the order of 10.7 m in a preferred embodiment, are monobloc sections or, in a modification, sections made from two parts welded together.

Figure 8:
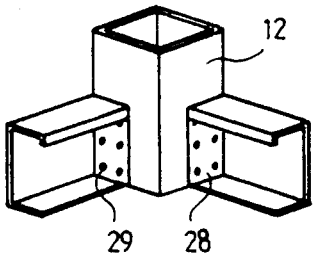

As can be clearly seen in FIGS. 7 and 8, the webs 20 of some of the longitudinal members 15 are cut out in the vicinity of the ends so as to allow the passage of an edge beam 27 and are further pierced with holes 25 whose purpose will be stated hereafter, whereas other longitudinal members, such as the one marked $15_1$ in FIG. 2, have at their ends plates 28 in which are formed two rows of three holes 29.

Figure 4:
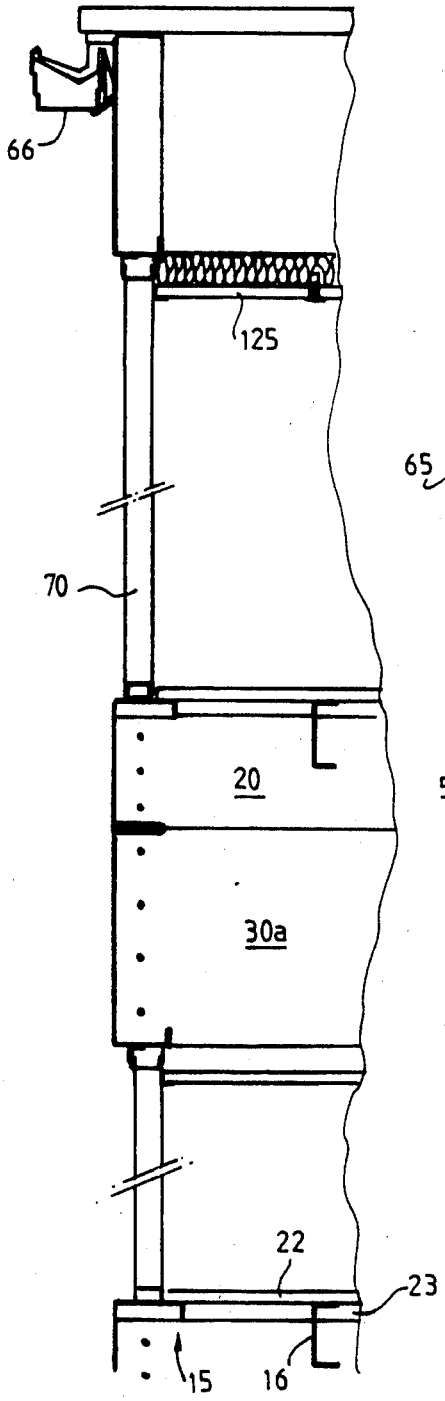
FIG. 4 is a view similar to that of FIG. 3 but on a smaller scale and for two superimposed modular elements.

The cross pieces 16 whose length is of the order of 4.2 meters in an advantageous embodiment are preferably formed by steel channel sections whose ends are cut out so as to allow fixing thereof by welding to the longitudinal members 15 so that one of the flanges of said cross pieces is flush with the flange 22 of the longitudinal members 15, FIG. 4, so that the flat surface of said flanges is adapted to receive a floor 26, advantageously formed from cellulose and mineral based fiber-board panels fixed to the cross pieces by means of wing screws (not shown).

The two half frames 14 are joined together by means of bolts introduced into the holes 25 of adjacent longitudinal members and the assembly is completed by bolting at the ends of two edge beams $27_1$ and $27_2$, FIGS. 2 and 7, having the same cross section as that of the longitudinal members 15.

After assembly of the two half frames 14, four steel posts 12 are fixed to the corners of the floor by bolts introduced into the holes 29 of plates 28 and at the top part of said posts are fixed external steel longitudinal members $30_1$ and $30_2$, having a profile similar to that of the longitudinal members 15, with however, a web 30*a* of a greater height than the web 20 of longitudinal members 15 and an arrangement different from that of said longitudinal members since the bend such as 23 of the longitudinal members 30 is provided at the bottom part and not at the top part of the longitudinal member.

The periphery of ceiling 13, whose longitudinal members $30_1$ and $30_2$ form the longitudinal edges, is completed by two edge beams 31 and 32 fixed by bolts to said longitudinal members and to which are also fixed, by means of bolts, two intermediate longitudinal members $33_1$ and $33_2$ parallel to and coplanar with, respectively, the longitudinal members such as 15 of the floor 11 of the element. The ceiling longitudinal members 33 whose structure is identical to that of longitudinal members 30 and which are formed either from a monobloc section or by welding two adjacent parts together are joined together at their ends and, if required, in their middle zone, by bolts.

Figure 9:
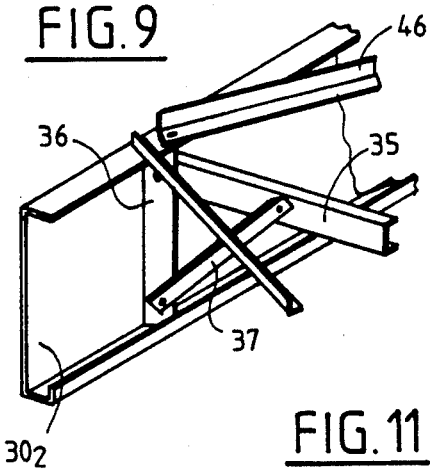

The ceiling 13 also comprises spacers 35, FIGS. 1, 2 and 9, spaced evenly apart along the longitudinal members 30, 33 and fixed thereto by bolting to flat bars 36 (FIG. 9) welded to the web 30*a* of longitudinal members 30, inside these latter. The structure is further rigidified by means of braces 37 bolted to the spacers 35 and the bars 36 of the longitudinal members 30 which are provided to be situated on the gable frontages of buildings formed by assembly of elements in accordance with the invention.

A structure such as described above is self supporting and, after bolting together of its constituent elements on the construction site, it may be positioned by means of the usual lifting means available on a work site, such as cranes or the like.

Figure 10:
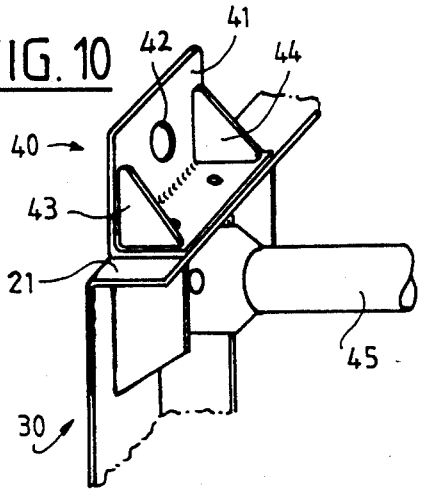

For this, the invention provides on the upper flange such as 21 of longitudinal members 30 lifting lugs 40 fixed by means of bolts, FIG. 10, said lugs being formed by an L shaped steel section segment whose face 41 is pierced with a hole 42 and whose two legs are joined together and reinforced by end cheeks 43 and 44. Transport diagonals 46 and lifting spacers 45, shown schematically in FIGS. 1, 2 and 9, contribute to the rigidity of the element of the invention during transport and lifting, which may take place by means of slings e fixed to the lifting lugs 40 for positioning an element 10 on beams L, four in number in the example shown in FIGS. 1 and 2.

Figure 11:
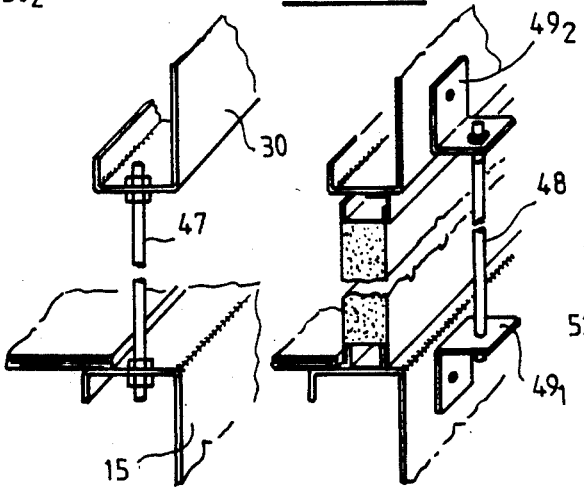

For handling at the place of assembly and the place of use, when they are different, the invention provides, as shown in FIG. 11, inner tie rods 47 fixed by nuts and lock nuts between the flanges of longitudinal members 15 and 30 and, similarly, external tie rods 48 fixed by nuts and lock nuts to brackets $49_1$ and $49_2$ screwed to the external faces of the webs 20 and 30*a* of longitudinal members 15 and 30.

An element 10 such as described above, in which the corner posts 12 have a height of about 3.20 m is provided for forming a ground floor element of a building whose first floor is formed by a prefabricated modular element very similar to that forming the ground floor and which is shown at 50 in FIG. 1.

Such an element 50 comprises a floor 51, of a structure identical to that of floor 11 of element 10 and corner posts also of a structure similar to that of posts 12 of element 10: However, although the floor again comprises external longitudinal members 52 and 53, of the same shape and dimensions as the longitudinal members 30, and edge beams identical to beams 31, 32, it does not comprise intermediate longitudinal members such as members 33 whereas purlins 54 instead of spacers 46 are fixed to the longitudinal members 52 and 53. The purlins 54 also formed by steel channel sections, but of different heights for giving a certain slope to the roof, are fixed to the longitudinal members 52 and 53 by bolts, FIG. 12, so as to project with respect to the flanges of said longitudinal members 52, 53 which have a structure identical to that of the longitudinal members 30 of element 10.

The floor element 50 also comprises purlin struts 55 fixed by bolts to the purlins 54 on the one hand and to flat bars 56, on the other, as well as lifting lugs 40, spacers 45 and wind bracing diagonals 46 similar to the means provided for element 10. In addition, ribbed roof trays 60, FIG. 13, made from galvanized metal sheet, fixed to the purlins 54 by self tapping screws 61, bridges and staples, with interpositioning of elastomer and/or plastic material sealing washers, form the roof of the element which is completed by means of a strip 65 somewhat in the form of a , made from prelaquered steel. The same is fixed by fish plates not shown to the longitudinal member 52 and to an end rib of a roofing tray, FIG. 13, whereas a zinc gutter 66, FIGS. 1 and 4, is provided on the edge beam.

For handling the element between the place of assembly and the place of use, when they are different, the invention provides for element 50 as for element 10 internal and external tie rods similar to those shown in FIG. 11.

The self supporting metal structures of elements 10 and 50, such as described above, are adapted for fitting panels intended to form the walls of the buildings likely to be constructed from the elements of the invention.

As shown in FIG. 3, a sandwich panel 70, comprises a foam material web 71, for example a polyisocyanurate foam enclosed between two factory prelaquered and galvanized metal sheets 72 and 72, the first of which is bent at the bottom part towards the inside of the panel. The periphery of this latter, whose dimensions may be of the order of $2.5 \times 1.15$ m, is formed by channel sections 74, made from galvanized bent metal sheet, with interpositioning of an adhesive seal 75 between the metal sheets 72 and 73 and the opposite faces of the flanges of section 74.

Figure 6:
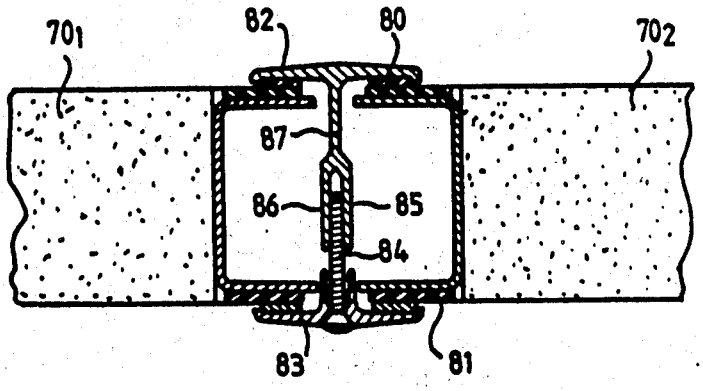
FIG. 6 is a sectional view on a smaller scale in the abutment zone of two-panels.

For constructing curtain walls by means of the panels 70 of the invention, two adjacent panels $70_1$ and $70_2$, FIG. 6 are placed end to end and, after positioning of seals such as 80 and 81, these latter are covered with butt joints, in the form of a T, 82 and 83, made advantageously from aluminium and which are joined together by means of screws 84 cooperating with the two lips 85 and 86 provided at the end of the body 87 of the T shaped section 82.

For the simple assembly and sealing of panels 70 between longitudinal members 15 and 30, or between the edge beams 27 and 32, or else between the longitudinal members of the floor of element 50 and the longitudinal members 52, 53 of the ceiling of said element, the invention provides fixing on a ceiling longitudinal member or an edge beam and using self tapping screws a channel section 92 with interpositioning of seal 91; the spacing between the flanges of section 92 is less than that between the flanges of the section 74 of panel 70, so that overlapping of the first by the second is possible. Drainage holes 93 are formed in the flange of the outwardly turned section 92.

For sealingly mounting panels 70 at the top part, in accordance with the invention, the edge of a panel is immobilized between a section made from steel plate bent into the form of a Z, 95, fixed by bolts 96 to the bend 23 of a ceiling longitudinal member and an aluminium angle iron 98 fixed to flange 22 by means of self tapping screws 97 with interpositioning of a seal 99. A seal 100 is also inserted between the other flange of angle iron 98 and the external face of the metal plate 72 of panel 70, silicon seals 101 and 102 applied to the ends of the external flange of angle iron 98 contributing to the correct sealing of the assembly.

Figure 5:
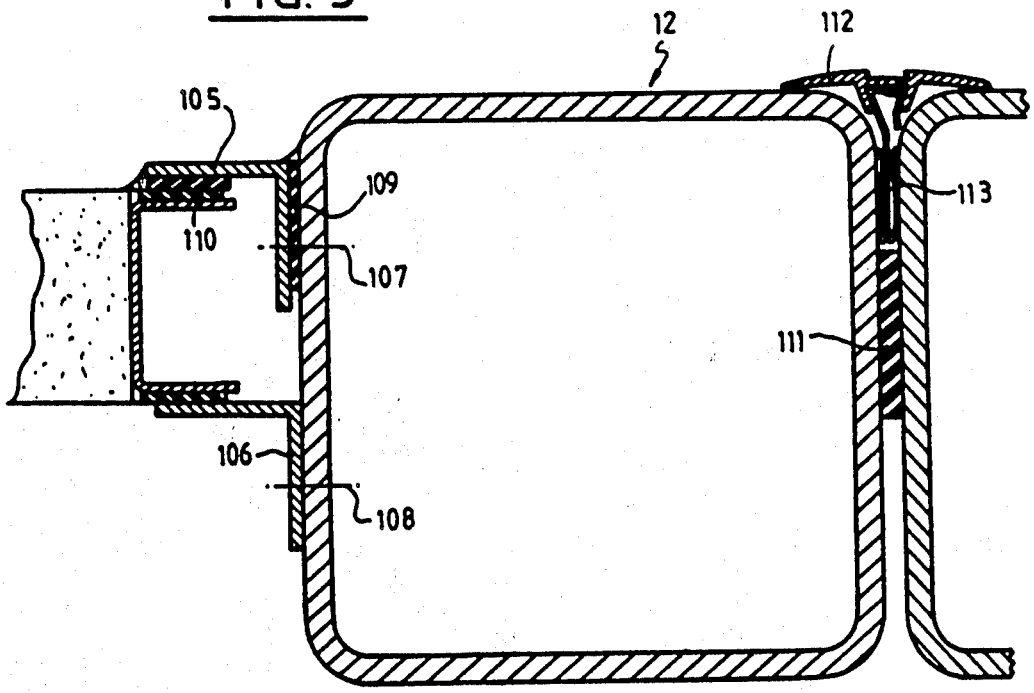
FIG. 5 is a horizontal sectional view on a larger scale and in the vicinity of a corner post.

For sealingly mounting the curtain walls at their junction with posts 12, the invention uses similar means, in the form of aluminium angle irons 105, 106 fixed to a post 12 by self tapping screws 107 and 108, respectively, with interpositioning of seals such as 109 and 110, FIG. 5.

To complete the sealing at the junction of two posts 12, a seal 111 is provided and a butt strip made from aluminium 112 is clipped by a pin 113, FIG. 5.

Figure 15:
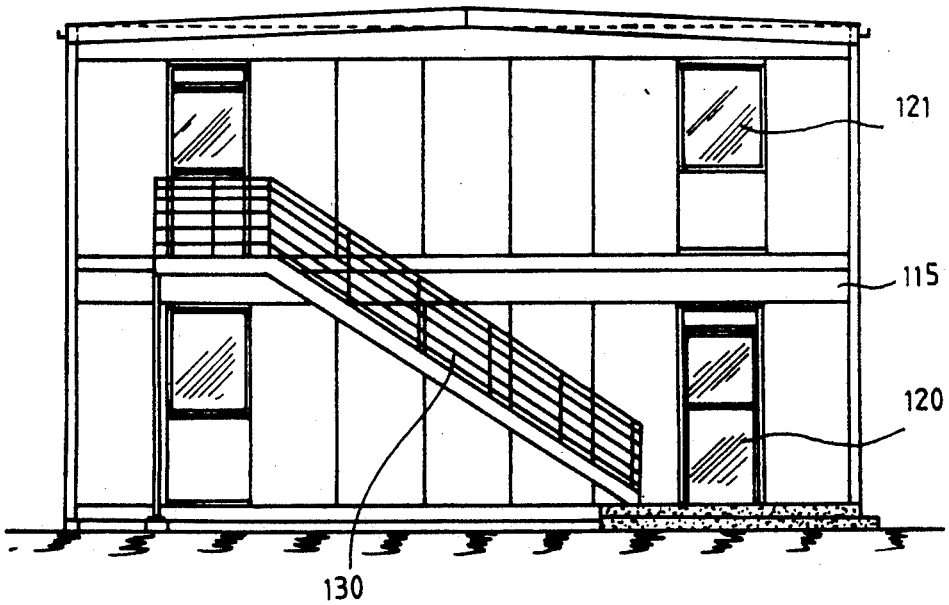
FIG. 15 is a view through the gable of a building according to the invention.

The panels 70 forming the curtain walls—which are not bearing walls—may be replaced at will by factory prefabricated panel elements, bordered with a channel iron frame similar to channel iron 74, in which a one leaf door device such as shown at 120 in FIG. 15 may be fitted or a French style window device 121 as also shown in this Figure. Such aluminium frame door and window devices will not be described here in detail since they are known per se.

The method of constructing a building from the elements such as described above follows directly from the foregoing.

For erecting a ground floor element 10, two floor half frames 14 are joined together, as shown schematically in FIG. 7, and the edge beams such as $27_1$ and $27_2$ are fixed to the ends of said floor 11. The posts 12 are fixed at their lower part to the longitudinal members 15 of the floor and to said posts are fixed the external longitudinal members of the ceiling $30_1$ and $30_2$. The intermediate ceiling longitudinal members $33_1$ and $33_2$ are then fixed to the ceiling edge beams 31, 32 and the spacers 35 are positioned on the ceiling longitudinal members by bolts, as explained above with reference to FIG. 9.

After positioning of braces 37 and transport 46, the lifting lugs 40 and spacers 45 are fixed by bolting. The longitudinal members are then provided with channel sections 92 for receiving panels 70 and their seals whereas the angle irons of the ceiling longitudinal members and the angle irons 105 intended to be fixed to the vertical posts 12 are positioned. Panels 70, solid or comprising a window and/or door device, are then presented and after the Z shaped sections 95 have been fixed with interpositioning of the sealing means provided, to the upper longitudinal member and after sections 106 have been fixed to posts 12, the butt-strips 82 and 83 are placed at the junction of adjacent panels 70.

It is a similar method of operating which is used for erecting a floor element 50 which is also formed by joining together two floor half frames, by bolting the corner posts, and by fixing the peripheral longitudinal members 52 and 53 of the ceiling and floor and ceiling edge beams.

Figure 12:
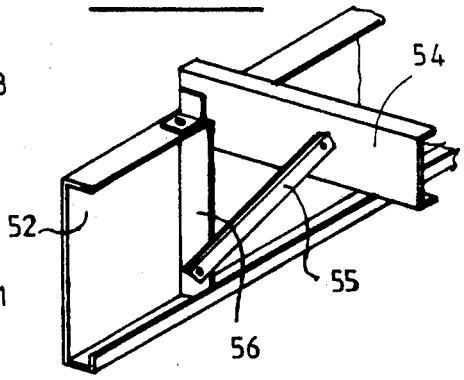

After the purlins 54 and the braces 55 have been fixed, FIG. 12, element 50 is provided with roof wind braces, lifting lugs 40, spacers 45, as well as external and internal tie rods, such as 47 and 48, when the assembly place is different from the building place.

Figure 13:
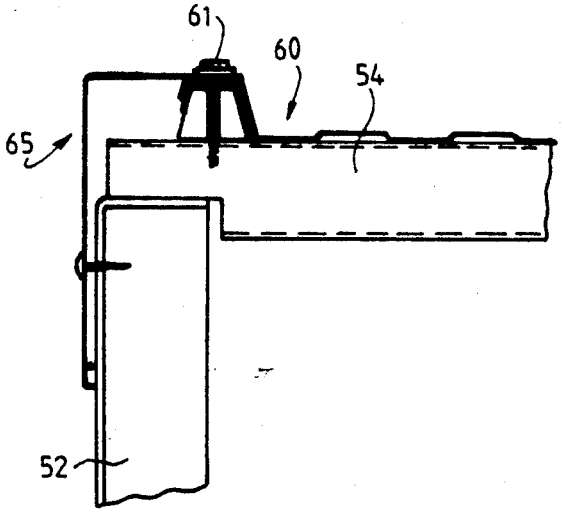
FIG. 13 is a schematical sectional view illustrating the roof means of an element according to the invention.

These operations are followed by the positioning and fixing of the roof trays 60, FIG. 13, and mounting of the frontage panels, whether it is a question of solid panels or door and/or window panels.

For constructing a building, ground floor elements such as $10_1$, $10_2$, FIG. 14, are placed side by side on the foundations, for example the beams 6, using the usual lifting means, slings of a length of about 5 m and with admissible loading of 4 tons having proved satisfactory. After having been levelled, the adjacent elements 10 are joined together by bolting the floor and ceiling longitudinal members together and by means of bolted blocking pieces, not shown.

A trap formed in each of the two half frames 14 allows the floor longitudinal members of two adjacent elements to be assembled together.

Figure 16:
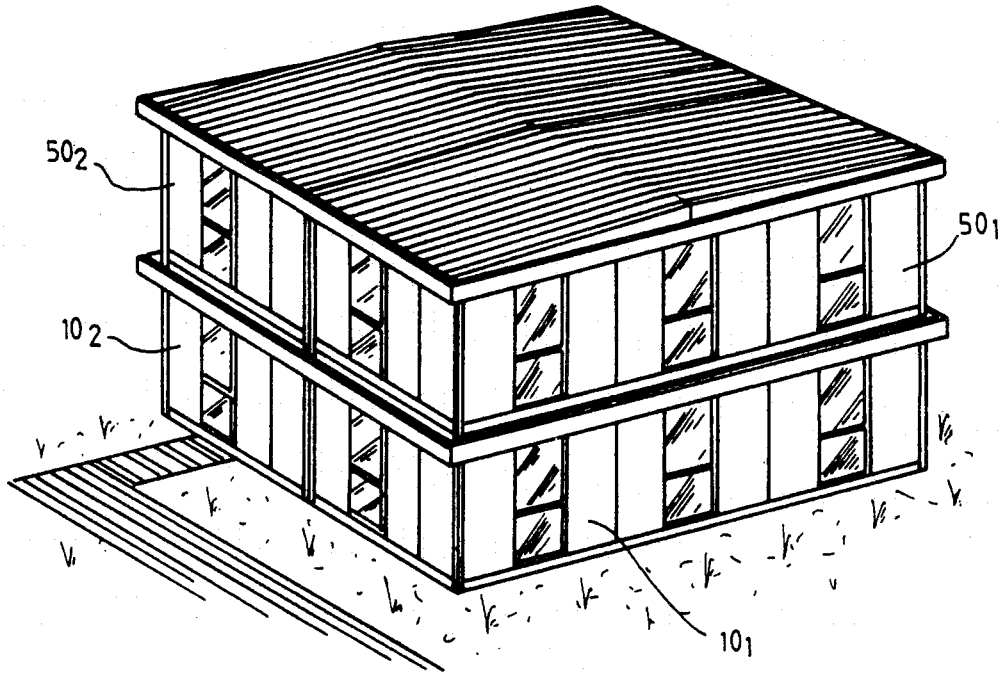
FIG. 16 is a perspective view of such a building.

In the case of a two storied building, as shown in FIGS. 14, 15 and 16, a seal is then positioned on the ceiling longitudinal members $30_1$ and $30_2$ of elements $10_1$ and $10_2$ and, on these elements, are placed current story elements $50_1$ and $50_2$ using a lifting means G and slings e fixed to lugs 40 of said elements 50, said lugs, as well as the lifting spacers, then being removed The longitudinal members of adjacent and superimposed elements are then joined together by means of bolts. Then the roofing strips 65, gutters 66 and rainwater down pipes are positioned, as well as a strip 115 facing the contact zone of the floor and ceiling longitudinal members of a superimposed element 10 and element 50.

The structure of the building is then as shown schematically in section in FIG. 4 or in elevation in FIG. 15 and in perspective in FIG. 16.

In one embodiment, which is that shown in FIG. 15, access to the current story is provided by means of a staircase 130 fixed to the gable.

The inner fittings generally provided at the place of assembly of the modules, namely the positioning of the connections of the floors 26 previously laid on the ground floor and current story elements, the fitting of dividing walls and inner doors, the fitting of a suspended ceiling 125, FIG. 4, with if required interpositioning of insulation means is provided before the modules are positioned on the building site. It is completed, if required, by a wall covering, piping and sanitary apparatuses as well as electric circuits.

The external finishing, extremely simple, consists in applying a finishing mastic seal, advantageously of the polyurethene type, to the connections between posts and longitudinal members, as well as to the connections of the aluminium butt-strips.

What is claimed is:

1. A prefabricated modular building element comprising two identical metal half frames each formed by an assembly of first longitudinal members and cross pieces which are assembled together to form a floor of said element, a ceiling comprising second longitudinal members and spacers, or second longitudinal members and purlins, corner posts connecting said floor to said ceiling for forming a self supporting structure, bolts means for assembling together the parts constituting said element, and removably fixed means for lifting said element fixed at predetermined zones of said structure.

2. The element as claimed in claim 1, wherein the floor and ceiling longitudinal members are steel sections having a cross section in the form of ⊏, i.e. a channel section with parallel flanges with a bend, at the end of one of said flanges, perpendicular to said flanges.

3. The element as claimed in claim 1, further comprising steel edge beams sections having the same cross section as that of the longitudinal members and connecting said floor longitudinal members and ceiling longitudinal members at their free ends.

4. The element as claimed in claim 1, comprising a ceiling with longitudinal members and purlins, further comprising, for the current story of a building, roofing means shaped as trays adapted to be fixed by means of screws to said purlins and means for completing the roof such as string-courses, gutters and the like.

5. The element as claimed in claim 1, further comprising non bearing curtain walls formed by assembly of solid panels or panels with a door and/or a window device each comprising a foam material web covered with metal plates and whose periphery is a channel section secured to said metal plates with interpositioning of a sealing joint.

6. The element as claimed in claim 5, comprising a channel section for mounting the curtain walls formed by said panels with which the peripheral section of said panels is adapted to cooperate with overlapping and shaped means provided on the longitudinal members and/or the corner posts of said element for holding said panels in position.

7. The element as claimed in claim 5, wherein the connection of two adjacent panels is provided by means of T shaped butt straps adapted to be joined together by the cooperation of screws and lips forming the end of the web of one of the straps with interpositioning of sealing means.

8. The element as claimed in claim 1, further comprising for the transport and/or lifting thereof transport diagonals, spacers as well as internal tie rods, extending between the facing flanges of said first and second longitudinal members, brackets fixed by bolting to the substantially facing webs of said first and second longitudinal members and external tie nuts extending between said brackets and fixed thereto by nuts and lock nuts.

9. A building adapted to be formed by assembling together a first and a second modular element, said first element comprising two identical metal half frames each formed by an assembly of first longitudinal members and cross pieces which are assembled together to form a floor of said element, a ceiling comprising second longitudinal members and spacers, corner posts connecting said floor to said ceiling for forming a self supporting structure and bolts means for assembling together the parts constituting said element, said second element comprising two identical metal half frames each formed by an assembly of first longitudinal members and cross pieces which are assembled together to form a floor of said element, a ceiling comprising second longitudinal members and purlins, corner posts connecting said floor to said ceiling for forming a self supporting structure roofing trays above said ceiling and bolts means for assembling together the parts constituting said element and means for assembling together said first and second elements with interposition of seal means between the second longitudinal members of said first element and the first longitudinal members of said second element.

10. The building as claimed in claim 9, comprising a plurality of first elements and a plurality of second elements superimposed onto said first elements, bolts disposed horizontally for connecting together adjacent longitudinal members of said first elements and of said second elements respectively, and bolts disposed vertically for connecting together superimposed longitudinal members of said first and second elements.

11. The building as claimed in claim 9, further comprising internal fitting elements such as a suspended ceiling, a floor, or the like.

12. The building as claimed in claim 9, further comprising an external staircase on one gable face thereof.

* * * * *